United States Patent [19]

Barch et al.

[11] 4,239,162

[45] Dec. 16, 1980

[54] FIBER TRAVERSING SPIRAL

[75] Inventors: Herbert W. Barch, Natrona Heights; Rudolph Blair, Gibsonia, both of Pa.

[73] Assignee: PPG Industries, Inc., Pittsburgh, Pa.

[21] Appl. No.: 44,604

[22] Filed: Jun. 1, 1979

[51] Int. Cl.[3] ..... B65H 54/28

[52] U.S. Cl. ..... 242/43 R; 242/18 G; 242/43.2

[58] Field of Search ..... 242/43 R, 43.2, 18 G

[56] References Cited

U.S. PATENT DOCUMENTS

| | | | |
|---|---|---|---|
| 2,391,870 | 1/1946 | Beach | 242/43 R |
| 2,433,304 | 12/1947 | Stream | 242/43 R |
| 2,989,258 | 6/1961 | Margason | 242/43 R |
| 3,040,999 | 6/1962 | Hayden et al. | 242/43 R |
| 3,043,530 | 7/1962 | Healy | 242/18 G X |
| 3,292,872 | 12/1966 | Hayden | 242/43 R |
| 3,356,304 | 12/1967 | Genson | 242/43 R X |
| 3,399,841 | 9/1968 | Genson | 242/43 R |
| 3,784,121 | 1/1974 | Arno et al. | 242/43 R |
| 3,861,608 | 1/1975 | Mohr et al. | 242/43 R |
| 3,946,957 | 3/1976 | Van Gunten et al. | 242/43 R |
| 4,025,002 | 5/1977 | Sutton et al. | 242/18 G |

FOREIGN PATENT DOCUMENTS

| | | | |
|---|---|---|---|
| 20417 | 11/1966 | Japan | 242/18 G |

*Primary Examiner*—Stanley N. Gilreath
*Attorney, Agent, or Firm*—John E. Curley; Paul A. Leipold

[57] ABSTRACT

A traversing device composed of a central shaft or axle with a wire for traversing of the strand arranged in a generally oval shape surrounding the shaft. The wire in the oval shape is supported such that the plane of the oval is traverse of the shaft at an acute angle and the wires of the oval are generally at an equal distance from the shaft at all points.

5 Claims, 23 Drawing Figures

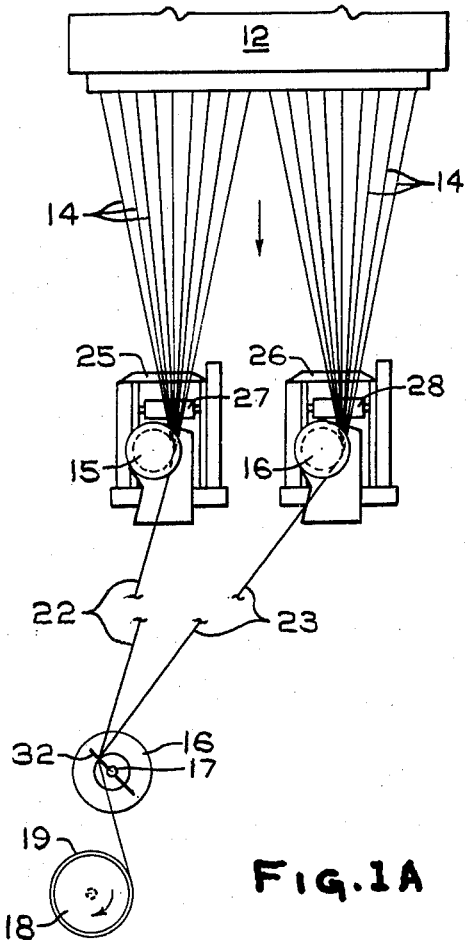
FIG. 1A
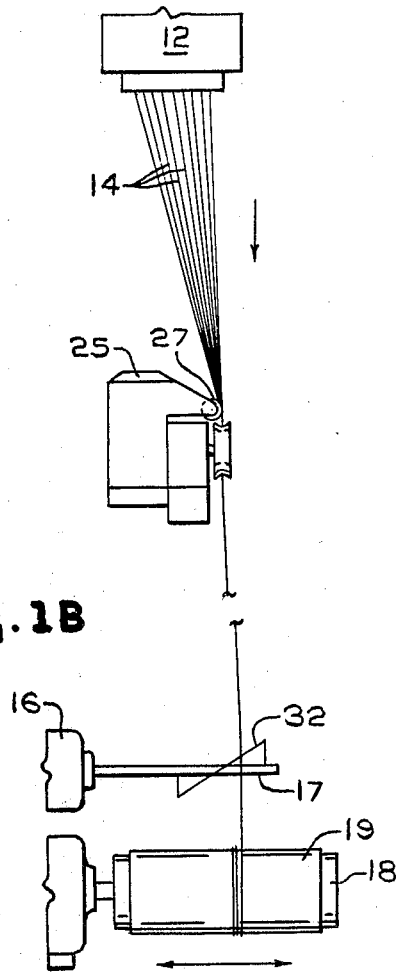
FIG. 1B
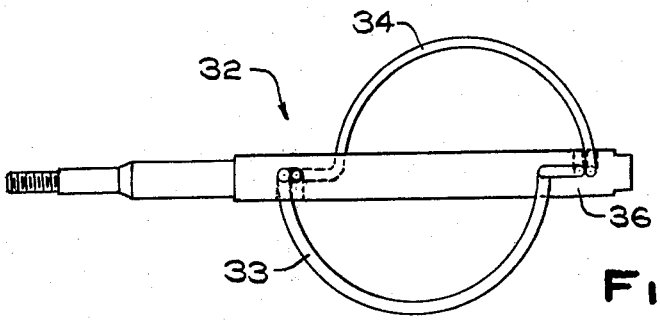
FIG. 2A
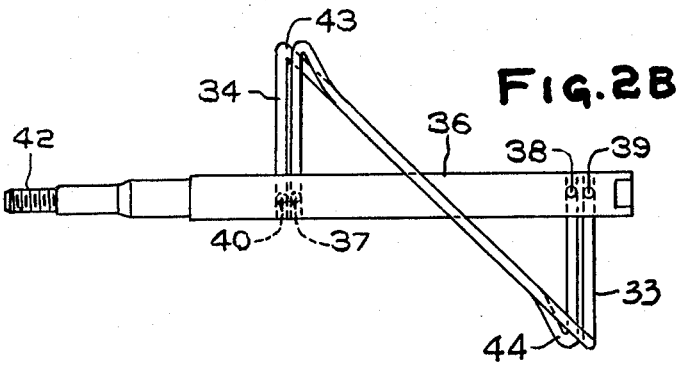
FIG. 2B
FIG. 2C
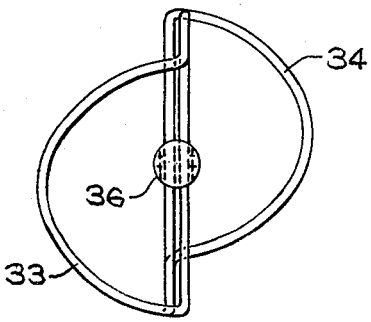

FIG. 2D
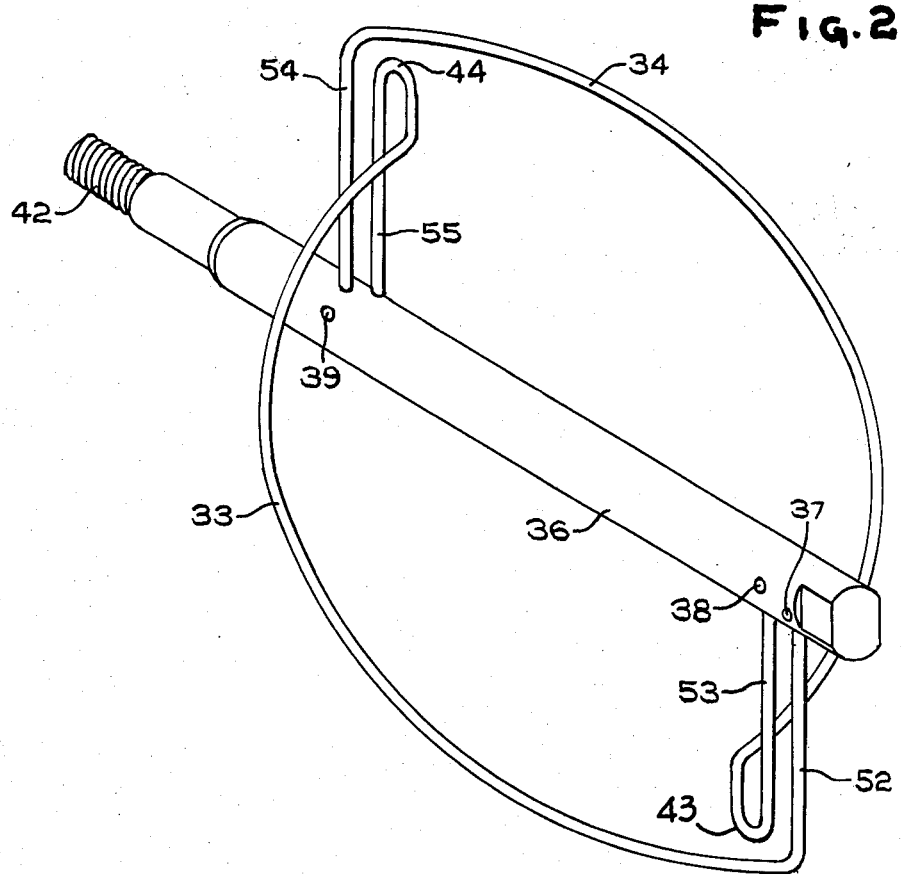
FIG. 3A
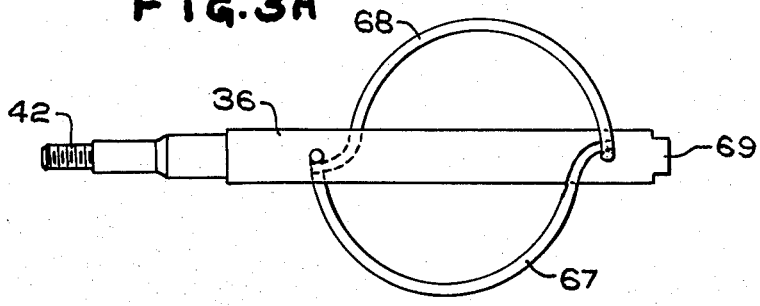
FIG. 3C
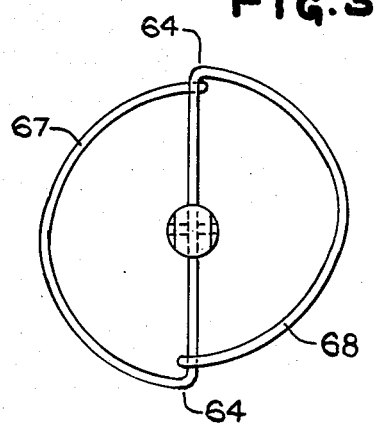
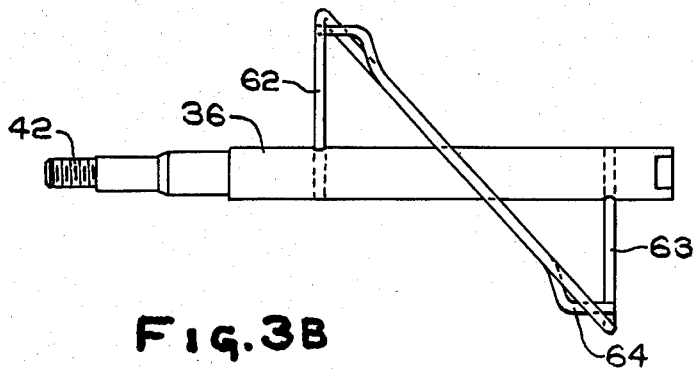
FIG. 3B

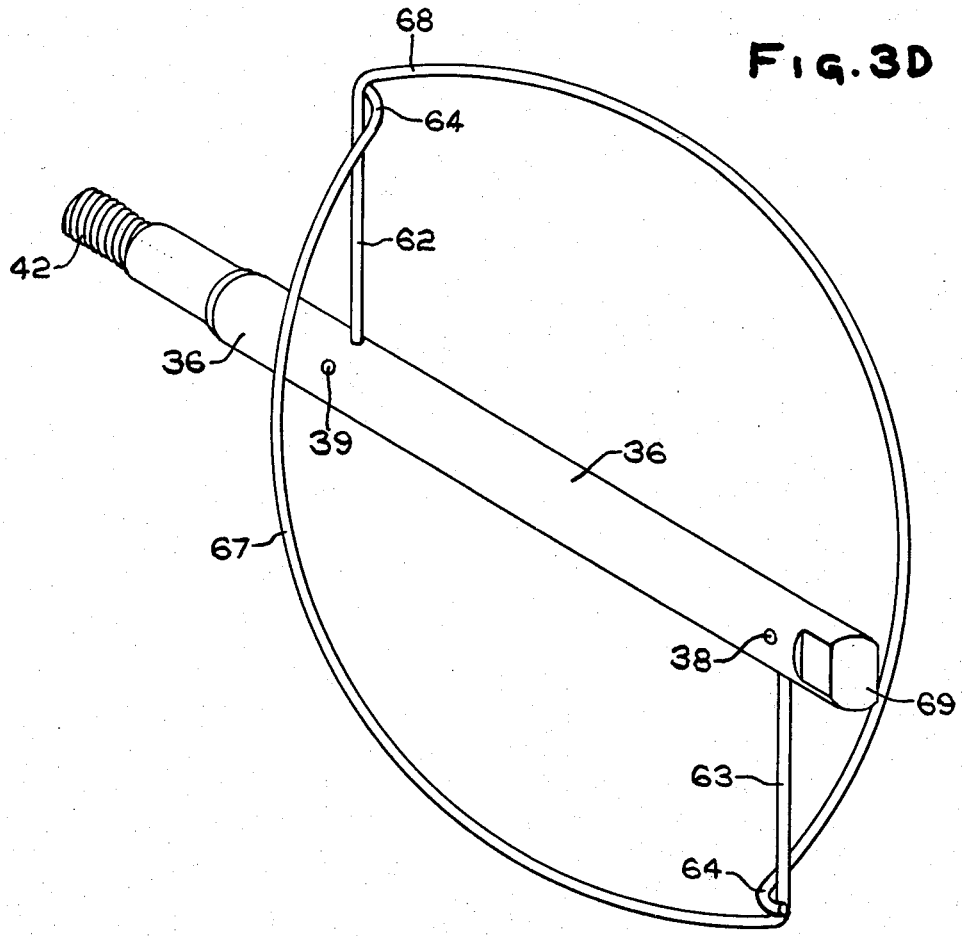
FIG. 3D
FIG. 4A
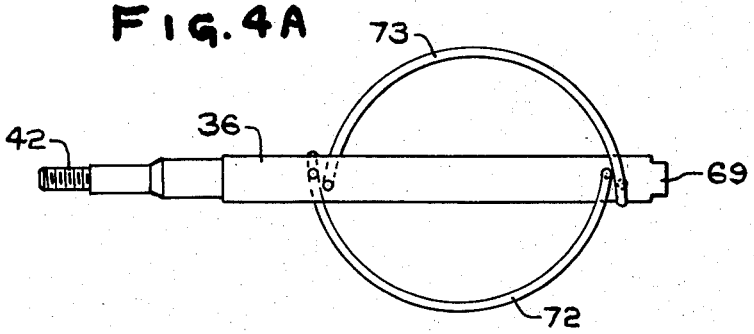
FIG. 4C
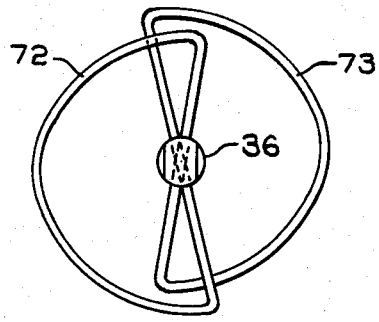
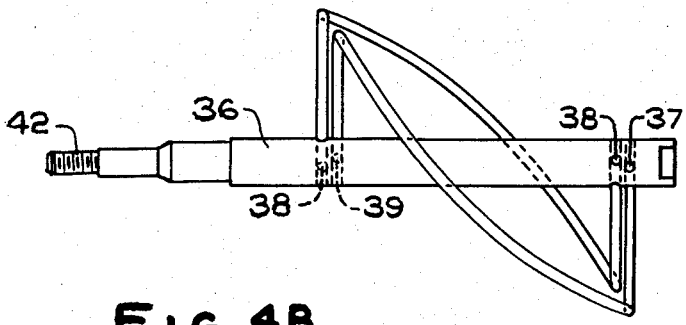
FIG. 4B

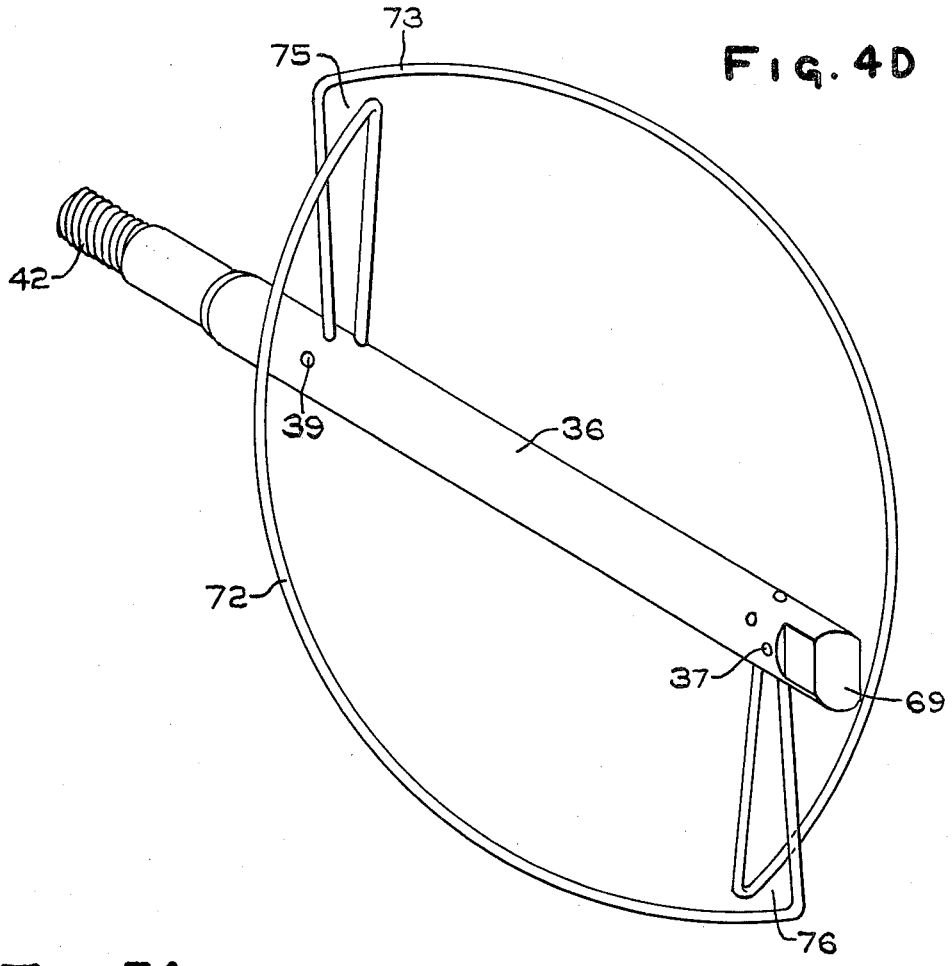
FIG. 4D
FIG. 5A
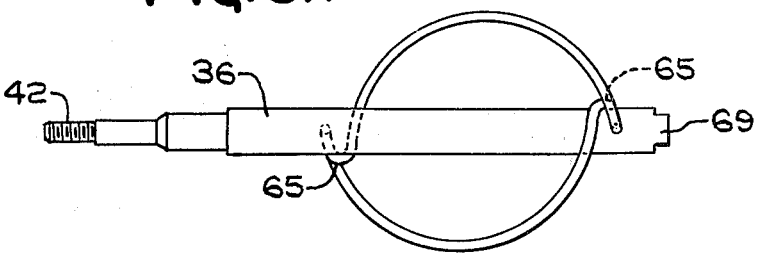
FIG. 5C
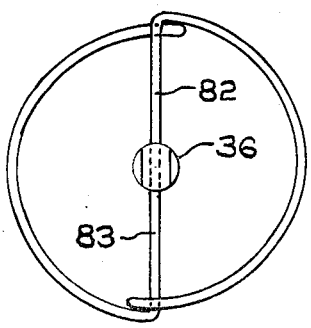
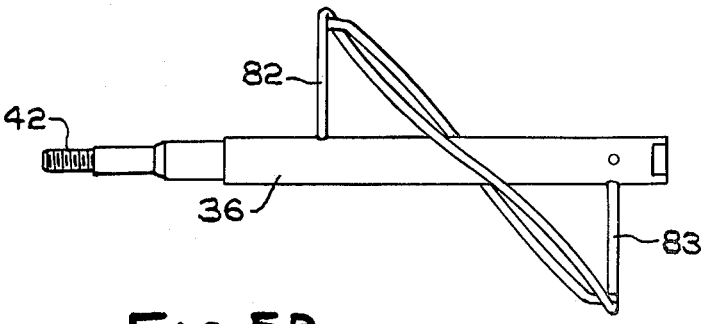
FIG. 5B

FIG. 5D
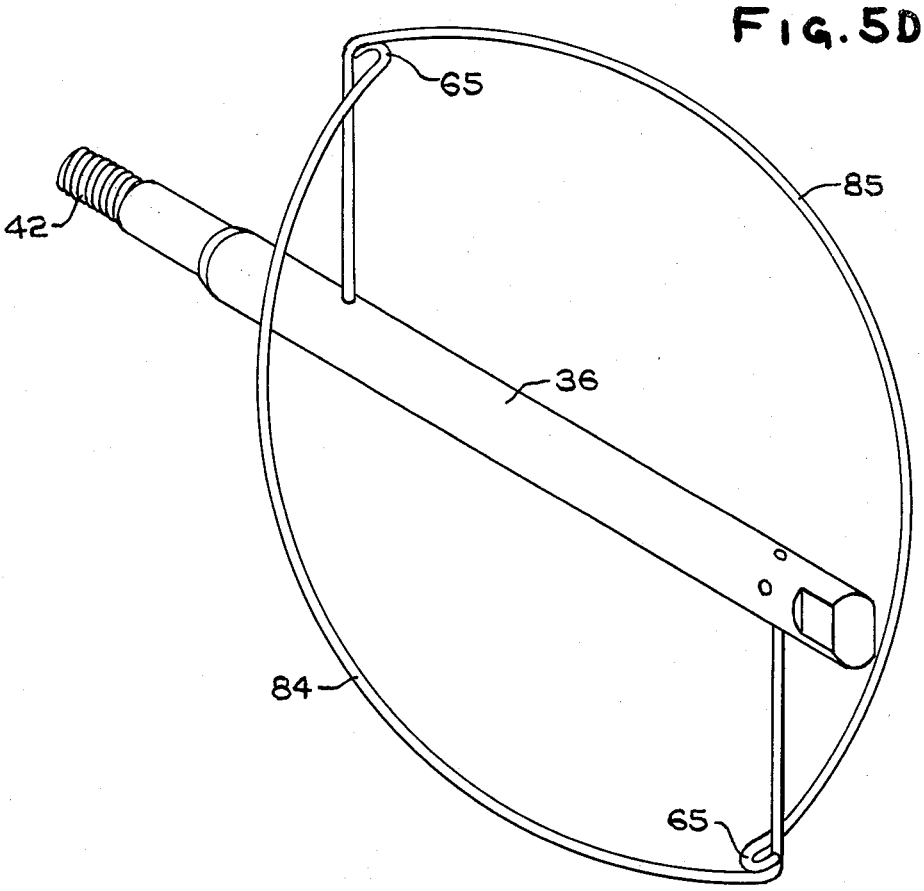
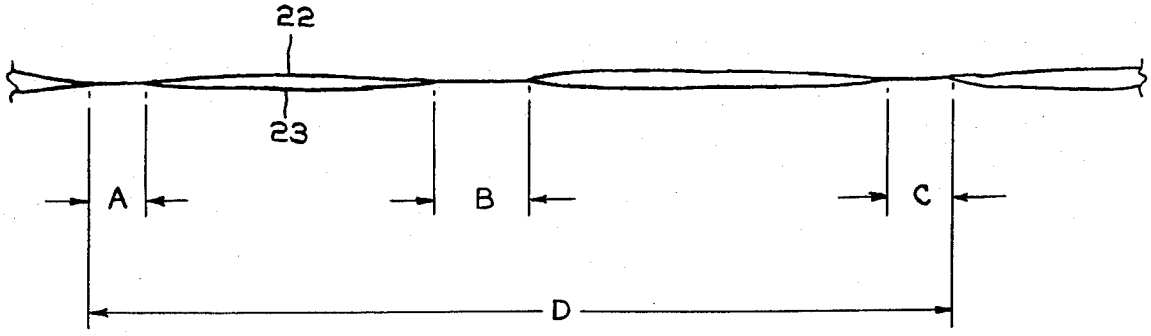
FIG. 6

FIBER TRAVERSING SPIRAL

BACKGROUND OF THE INVENTION

1. Field of the Invention

This invention relates generally to improved apparatus and method for packaging strand material. More particularly, this invention relates to an improved traversing or spiral mechanism for traversing strand material such as glass strand being wound on a rotating support.

2. Prior Disclosures

Continuous glass fibers are commercially produced by exiting a multiplicity of molten streams from a feeder and applying sufficient pulling force to the streams to attenuate them into fine filaments. A number of filaments are converged to form a strand which is wound onto a package on a rotating support.

In the winding of the glass strands onto the rotating support, the speeds are such that it is not generally possible to precision wind the package with a precise control of the lay down of the strand on the package. The speeds of the strand may be on the order of up to about 5,000 to 10,000 yards per minute (about 4500–9000 m/min). In order to overcome the difficulty with precision winding, it has been the practice to use a traversing mechanism that throws the strand back and forth as the rotating package is moved axially below the traversing mechanism. The utilization of some sort of spiral to agitate the strand prior to its winding is necessary in order to be able to easily withdraw the strand from the forming package. If the strands are wound with each winding next to the prior one such as in a spool, it is not possible to unwind the strands after they are dried.

In U.S. Pat. No. 2,391,870 to Beach, there is disclosed a traversing mechanism comprising two wires in a generally spiral pattern around a central shaft. This device while successful in traversing the strands so that the packages may be unwound does cause some undesirable properties in the fiberglass strand produced. The traversing mechanism of Beach apparently causes the strand to be flat making the product less desirable for uses such as chopping of the strand for resin reinforcement. Further, the spiral such as in Beach is considered to cause breakouts during winding. The traversing mechanism of Beach is not desirable for use as a traversing mechanism for the winding of several strands which have been split from a common bushing and are wound on the same package. The breakouts of the Beach traversing mechanism usually are caused by wear on the shaft of the mechanism by the glass strand hitting against it which leads to abrasion of the strand by the worn area and eventual strand breaking. This necessitates the replacement at relatively short intervals of traversing mechanisms such as in Beach.

In order to overcome the difficulties of the traversing mechanism such as in Beach, it has been proposed that traversing devices of several wires could be utilized such as in U.S. Pat. No. 3,784,121 to Arno et al and in U.S. Pat. No. 3,356,304 to Genson. However, these traverses with a multiplicity of wires are complicated to form as many wires of different design must be formed and then properly located on the traversing device. Therefore, there remains the need for a traversing device that would result in a product of improved quality for chopping, with better resin wetting properties, further there is a need for a device that would result in fewer breakouts of strands during winding. There is a need for a traversing device that would wind split strands so as to result in the ability to unwind better from a forming package and not be joined together by the action of the spiral during winding. Further, there is a need for a traversing mechanism of longer life of simple design and low cost.

SUMMARY OF THE INVENTION

It is an object of this invention to overcome the disadvantages of the prior processes and apparatus.

It is a further object to provide split strand from forming packages that has a high split efficiency.

It is another object of this invention to produce a rounder glass fiber strand.

It is an additional object of this invention to wind strands with fewer breaks.

It is another object of this invention to provide split strand forming packages that unwind easily.

It is another further object of this invention to provide a traversing device with superior abilities to wind split strands.

It is another additional object of this invention to provide a traversing device of long life.

It is again a further object of this invention to provide a traversing device of low cost suitable for split strand winding operations.

These and other objects of the invention are generally accomplished by providing a traversing device composed of a central shaft or axle with a wire for traversing of the strand arranged in a generally oval shape surrounding the shaft. The wire in the oval shape is supported such that the plane of the oval is traverse of the shaft at an acute angle and the wires of the oval are generally at an equal distance from the shaft at all points.

In a preferred embodiment of the invention, the oval wire arrangement is composed of two separate wires meeting at support points at the points the farthest distance apart on the shaft. At the points where the two wires forming the oval meet, there is provided a method of transferring the strand from one wire to the other and at the same time, changing the direction of the strand for traversing back across the second wire.

BRIEF DESCRIPTION OF THE DRAWINGS

FIG. 1A is a schematic front elevational view of apparatus for forming and winding strand material illustrating the positioning of the traversing means of the invention.

FIG. 1B is a side schematic view of the apparatus of FIG. 1A illustrating utilization of the traversing device of the invention.

FIGS. 2A, 2B, 2C, and 2D are vertical, horizontal, end and perspective views respectively of a traversing device of the invention.

FIGS. 3A, 3B, 3C, and 3D are side, vertical, end and perspective views respectively of a traversing device of the invention utilizing only two support wires.

FIGS. 4A, 4B, 4C and 4D are horizontal, vertical, end and perspective views, respectively, of a device in accordance with the invention formed of two wires and a central shaft.

FIGS. 5A, 5B, 5C, and 5D are vertical, horizontal, end and perspective views of a device in accordance with the invention utilizing two wires to form the strand carrying oval.

FIG. 6 illustrates a section of split strand with distance markings indicating the sections which are together.

DETAILED DESCRIPTION OF THE INVENTION

Figure 7:
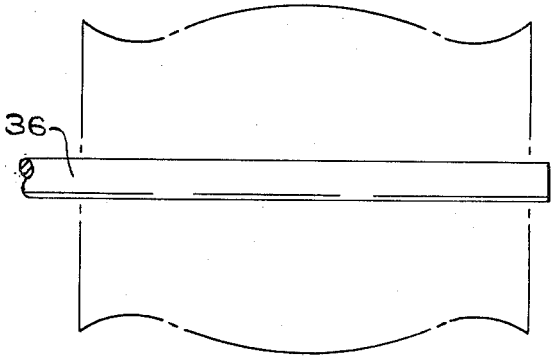
FIGS. 7, 8, and 9 are phantasmic outlines of the spirals of the invention when rotating.

There are numerous advantages of the traversing or spiral device of the instant invention. Among other advantages are that the strand which is traversed with the instant spiral is rounder than those produced with prior art spirals. Another advantage is that the product is improved for use as a chopped fiber in reinforced plastics as it has better wetting properties. Another advantage of the instant invention is that the spiral results in fewer breakouts and therefore is more efficient as more full packages are wound utilizing the instant spiral. Another advantage is that the spiral is able to wind split strands effectively without separating of the strands to too great a degree or causing the strands to be bound closely together. An additional advantage is that the instant strands may be chopped with less fuzz or fly being generated during chopping. The instant spirals also exhibit advantageous wear properties such that they are of long life. These and other advantages of the invention will become clearer after consideration of the drawings as discussed below.

Illustrated schematically in FIGS. 1A and 1B is the forming of split glass strands from a single bushing. The bushing 12 is provided with tips from which glass filaments 14 are drawn in two fan-like arrangements to gathering shoes 15 and 16 from which strands 22 and 23, respectively, are withdrawn. Prior to entering the gathering shoes 15 and 16, the filament fans are coated with a binder from devices 25 and 26 having belts 27 and 28 which contact the filaments prior to their being gathered into a strand. While illustrated as belts, the binder application may also be from a roller, pad or spray immediately prior to the gathering shoe. Filaments 22 and 23 pass substantially together over the spiral of the invention 32 which is supported by shaft 17 and rotated by motor 16. The strands 22 and 23 are wound onto collet 18 to form forming package 19. During the drawing of filaments of fiberglass from a bushing, very high speeds are generated in conventional practice. These speeds may be well over 5,000 yards (4500 m) per minute. Therefore, conventional traversing devices for precision winding are not suitable as the traversing speed must be too high. Therefore, rotating traversing devices capable of traversing a strand at very high speeds have been derived. These devices such as the device of the above-referenced Beach U.S. Pat. No. 2,391,870 provide rapid traversing of the strand during winding as the collet 18 is oscillated below the traversing device 32.

With reference to FIG. 2A, FIG. 2B, FIG. 2C and FIG. 2D, there is illustrated a traversing device or spiral in accordance with the invention. As illustrated in FIG. 2A, the spiral 32 is formed of two wires 34 and 33 supported by the central axle or shaft 36. The central shaft is threaded at 42 for insertion into the drive mechanism. The wires 33 and 34 are fastened to shaft 36 by set screws which hold the wires in holes in the shaft 36. The set screws 40, 37, 38 and 39 may be removed for replacement or adjustment of the wires 33 and 34. Also, if the spiral is rotated in the opposite direction, then the wires may be reversed and reinserted for traversing when rotating in the opposite direction. Wire 34 is offset at the transfer point 44 so that the strand as it moves past the rotating spiral is transferred at that point to wire 33. Wire 33 at transfer area 44 transfers the carrying of the strand back to wire 34. The transfer point as illustrated by the traverses of FIGS. *2b, 2d, 3b, 3d, 4b, 4d, 5b,* and *5d* may be formed in several manners but generally involves the transferee wire being higher and farther outside than the transferor wire at the point of transfer. The transfer point also may be a hook 65 or a flat area 64 such as in FIGS. 5A–5D and FIGS. 3A–3D respectively.

The traverse of FIGS. 3A, 3B, 3C and 3D is formed with support legs 62 and 63. The wires forming the strand carrying surface are 67 with is welded to the support 62 and is bent to form support 63. Strand carrying wire 68 is as shown as bent from a continuous wire which also forms support 62. It is possible to weld both wires rather than form one integral with the supports, but the cost would be higher. The flattened transfer points 64 are lower than the transferee wirers. The traverse as illustrated is turned counterclockwise when viewed from end 69.

The traverse of FIGS. 4A, 4B, 4C and 4D is formed of separate wires 72 and 73, which are each bent to form two supports and a strand carrying surface between the supports. The wires overlap at the strand direction changing transfer points 75 and 76. The spiral, as shown, is to be rotated counterclockwise when viewed from the end. It may be rotated in the other direction if the position of the wires is reversed.

The traverse of FIGS. 5A, 5B, 5C and 5D is formed with two separated supports joined by the oval strand carrying wire surfaces. The transfer area 65 is formed by a hook in the transferor wire which is welded to the transferee wire below its area of highest extension from the center shaft. The strand ends its traverse in one direction in the hook and is the traversed in the other direction by contact with the higher transferee wire.

The spirals of the instant invention each have a generally oval pattern of the wire or wires on which the strands are carried. The plane of the oval is located at an acute angle to the shaft 36. The oval is supported by support means which may be located as convenient. As seen in the construction such as in FIGS. *2a, 2b, 2c,* and *2d,* the oval is formed of two wires which are bent to be integral with the leg members 52 and 53 at the outer end of the spiral and legs 54 and 55 at the inner end. In other embodiments such as in FIGS. *3a, 3b, 3c,* and *3d* and FIGS. *5a, 5b, 5c,* and *5d,* the support means are a single support. The wires 34 and 33 are maintained, as they follow the arcuate path from one leg to the other, at a substantially equal distance from the inner shaft 36.

The distance of the shaft from the oval strand carrying portions may be any suitable distance which results in good strand quality. A suitable distance has been found to be between about 1 and about 2 inches (about 2 to about 5 cm), height of the wire from the shaft. A preferred distance of the wire from the shaft has been found to be about $1\frac{3}{4}$ inches (about 45 mm). The length of the spiral along the shaft may vary by any suitable length which is desired for the particular traverse desired. A range of about 3 to about 6 inches (about 7 to about 16 cm) has been found to be suitable. A preferred length is about 4 inches (about 10 cm) between the support legs at the extremities of the wires forming the oval traversing surface.

Figure 8:
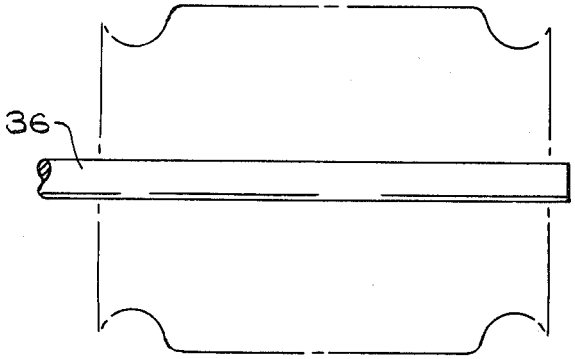
Figure 9:
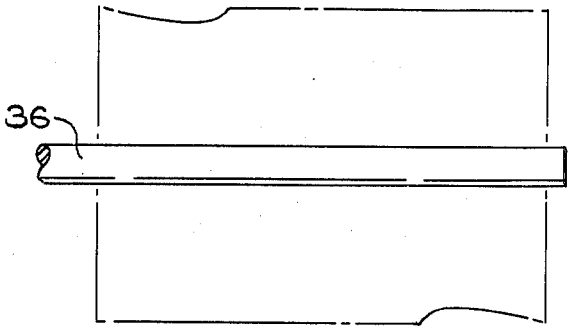
Figure 10:
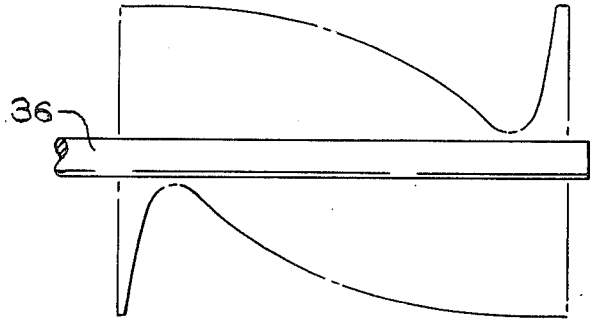
FIG. 10 is a phantasmic outline of a prior art spiral.

The traverses in accordance with the instant invention when they are rotating at operating speeds form a phantasmic outline that is generally of barrel shape. Phantasmic outlines in accordance with the invention are illustrated in FIGS. 7, 8 and 9. For comparison, FIG. 10 is the phantasmic outline of a prior art spiral according to the above-referenced Beach patent. The phantasmic outlines are believed to represent the path of the strand as it passes over the working surface of the spiral. As can be seen in FIGS. 7, 8 and 9 the spiral of the invention provides a generally even path for the strand with a slight concave portion at the ends where transfer from one direction to the other takes place. In contrast, as illustrated in FIG. 10, the commonest prior art spiral allowed the fiber to be very roughly treated and also to contact the shaft carrying the wires of the spiral with resulting abrasion of the strand and shaft.

In some uses of glass strand, it is desired that several separate strands be delivered from a single source. Further, sometimes it is desirable that a bushing with a large number of orifices be used for reasons of economics. In the instance of a large bushing, it is sometimes necessary to divide the filaments into two, three or four strands for best utilization and formation of desirable size strands. When several of these strands are wound on the same package, it is normally desired that they stay together reasonably well for placement on the collet in order that they may be unwound without difficulty. However, it is desirable that after they are unwound they separate over a great portion of their length in order that they form a higher bulk product. Such properties are especially desirable for formation of mats for needling and eventual use in reinforcement.

The spiral of the invention finds particular use in formation of such split strands. Splitting efficiency normally is defined as the ratio of the area where the strands are not held together to the overall length of a certain section. Illustrated in FIG. 6 is a typical split strand after removal from the dried forming package. The sections indicated as A, B and C are held together while the remainder of the strands are independent. The splitting efficiency is determined by subtracting the sum of A, B and C from D, dividing by D and multiplying by 100. The splitting efficiency available with the instant spiral is between 70 and 90 percent in comparison with the splitting efficiency of the spiral such as Beach where the splitting efficiency is only about 50 percent.

While the advantageous use of the invention with respect to the winding of split fibers has been discussed, the novel traversing device of the invention also finds advantages in winding of single strands in that a rounder strand results. A rounder strand results in better wetting of the strand when forming resin composites. It is theorized that a rounder strand allows passing of the resin between the strands better. Also, although it is not clear why this occurs, the strand that is wound utilizing the traversing device of the instant invention also results in less fuzz and fly being produced when the fibers are chopped such as for use in gunning with a resin for composite layup.

Several structures of traversing devices in accordance with the invention have been illustrated. The preferred embodiment is that of FIGS. 2*a*, 2*b*, 2*c* and 2*d* wherein the spiral is composed of two wires each of which is mounted into the shaft. Other structures such as FIGS. 3*a*, 3*b*, 3*c*, and 3*d* and FIGS. 5*a*, 5*b*, 5*c*, and 5*d* utilizing a continuous loop for the strand bearing surface with two supports must be welded at the support points and therefore are more expensive in fabrication. It is within the invention to utilize means of support other than at the extremities of the oval formed by the wire carrying the strand. It would be possible to support the oval wire at several points or to form the strand carrying surface of a solid oval generally planar structure which was welded to the shaft. The traverses of the invention may be utilized with any desired size glass strand. Further, the traverses of the invention are suitable for use with a strand that has been treated with any conventional binder material. The traverse of the invention has been found to operate in a particularly preferred manner with the binders that are applied in a composition of between 11 and 20 percent binder solids concentration as these binders are able to be operated with fewer breakouts of the strand utilizing the traverse of the invention.

The traverse may be operated at any suitable speed that results in good traversing action of the strand onto the collet. The speed of the spiral will vary depending on the type of strand being formed and the size of the collet. In a particular instance, the spiral of the invention has been operated at 1850 rpm with a 12 inch collet operating at about 3425 rpm. In another instance, the traverse of the invention has been operated at 1620 rpm with a 8¼ inch collet at 4500 rpm.

Although this invention has been described with reference to particularly preferred embodiments, those skilled in the fiber art will recognize that variations may be made in the practice of this invention. For instance, while the invention has been described particularly in relation to traversing a glass strand, the device of the invention also may be utilized for traversing artificial polymer strands such as nylon and polyester. Accordingly, this disclosure is intended to be illustrative rather than limiting, for instance, the traverse of the invention could be formed of materials other than preferred brass such as fiber-reinforced resins or stainless steel. It would also be within the disclosure to form a spiral having the generally oval traversing path configuration by utilization of more than two wires. Further, the traversing device of the invention could be utlized in rewinding of fibers at high speeds rather than always utilized in combination with forming of fibrous strands. The device also could be a solid oval sheet rather than formed of wires.

While the present invention has been described with reference to certain specific embodiments thereof, it is not intended to be so limited thereby, except as set forth in the accompanying claims.

We claim:

1. A spiral traversing device comprising a rotatable axle, a first wire strand support means generally in an oval planar shape, a second wire strand support means generally in an oval planar shape, two wire support means for said first wire strand support means, two wire support means for said second wire strand support means, the wire support means for the first and second wire strand support means being constructed to maintain said first and second wire support means at generally equal distances from said axle at all points in an oval planar shape and at an angle such that the plane of said wire ovals is at an angle to said axle, said wire support means for said first strand support means being affixed to the axle at spaced apart fixed distances along said axle thereby defining the length of the oval, said second wire support means for said second strand support means being affixed to the axle at spaced apart fixed distances along said axle thereby defining the length of the oval, the point of attachment of the wire strand support means to said first strand support means being higher than the point of attachment of the adjacent wire support means to said second strand support means at one point above the axle, and the point of attachment of the wire support means to said first wire strand support means being lower than the point of attachment of the adjacent wire support means to said second wire strand support means at its other point of attachment to the axle to thereby permit strand riding on said second wire strand support means to transfer from said second wire strand support means to said first wire strand support means at one end of said axle and from said first wire strand support means to said second wire strand support means at the opposite end of said axle.

2. The spiral traversing device of claim 1 wherein said wire strand support means overlap at the said wire support means.

3. The spiral traversing device of claim 1 wherein each said wire support means have a hook at one end, the hooks being positioned on the wire support means so that they are located on each wire support means at opposite ends of the axle.

4. A spiral traversing device comprising a rotatable axle, a first wire strand support means generally in an oval planar shape, a second wire strand support means in an oval planar shape, two wire support means attached to said axle, one positioned at one end of said axle, the other positioned at the other end of said axle, said first wire strand support means being attached to one said wire support means at one end of said axle at a point higher than the point of attachment of said second wire strand support means to the same wire support means at that end of said axle, said first wire strand support means being attached to said other strand wire support means at the opposite end of said axle at a point lower than the point of attachment of said second wire strand support means to the same wire support means at that opposite end of said axle to thereby define the length of the oval of each of said wire strand support means and to permit strand riding on said second wire strand support means to transfer to said first wire strand support means at one end of said axle and to transfer from said first wire strand support means to said second wire strand support means at the opposite end of said axle while maintaining said first and second wire strand support means at generally equal distances from said axle in an oval planar shape and at an angle such that the plane of said oval is at an angle to the said axle.

5. The spiral traversing device of claim 4 wherein the first strand wire support means has a flat area on the end which is higher than the second strand wire support means and wherein the second wire strand support means has a flat area on the end which is higher than said first wire strand support means.

* * * * *